US006925740B2

(12) United States Patent
Shannon

(10) Patent No.: US 6,925,740 B2
(45) Date of Patent: Aug. 9, 2005

(54) GRAVESITE MEMORIAL DISPLAY WITH FLOWER HOLDER FEATURE

(76) Inventor: Kevin Shannon, 569 Peter Paul Dr., West Islip, NY (US) 11795

( * ) Notice: Subject to any disclaimer, the term of this patent is extended or adjusted under 35 U.S.C. 154(b) by 0 days.

(21) Appl. No.: 10/645,092

(22) Filed: Aug. 21, 2003

(65) Prior Publication Data

US 2004/0139633 A1 Jul. 22, 2004

(51) Int. Cl.[7] ..... G09F 19/00
(52) U.S. Cl. ..... 40/124.5; 52/103
(58) Field of Search ..... 40/124.5, 718, 40/773; 52/3, 103, 104

(56) References Cited

U.S. PATENT DOCUMENTS

| | | | | |
|---|---|---|---|---|
| 669,412 A | | 3/1901 | Harriman | |
| 1,425,361 A | * | 8/1922 | Beroud | 52/3 |
| 1,924,149 A | * | 8/1933 | Britton | 40/124.5 |
| 1,966,922 A | * | 7/1934 | Coleman | 40/124.5 |
| 2,332,217 A | * | 10/1943 | Harner | 40/124.5 |
| D247,590 S | | 3/1978 | Atherton et al. | |
| 4,212,133 A | | 7/1980 | Lufkin | |
| 4,790,088 A | * | 12/1988 | Morvant | 40/124.5 |
| 5,553,426 A | | 9/1996 | Ostergaard | |
| 6,324,784 B1 | | 12/2001 | Bina | |
| 6,463,703 B1 | | 10/2002 | Mattis | |
| D467,436 S | | 12/2002 | Fink | |

* cited by examiner

*Primary Examiner*—Lars A. Olson
(74) *Attorney, Agent, or Firm*—Island Patent; F. Scott Tierno

(57) ABSTRACT

A gravesite memorial display includes a shell structured to provide a weathertight interior. The shell is constructed of at least one fixed portion, at least one movable portion, and a transparent portion. The transparent portion enables items placed within the interior of the display to be viewed by nearby individuals. The movable portion, which is movably coupled to the fixed portion is arranged to be movable between a closed position, wherein the interior is sealed, and an open position, providing access to the interior. When in the open position, an individual may place items for display purposes within the weathertight interior and or remove items from the interior.

12 Claims, 6 Drawing Sheets

GRAVESITE MEMORIAL DISPLAY WITH FLOWER HOLDER FEATURE

TECHNICAL FIELD

The present invention relates most generally to static display and presentation devices. More particularly, the invention relates to an anchorable gravesite memorial display, configurable with one or more flower holders, for use in displaying personal items such as photos, cards, and a variety of other possible items, including flowers.

BACKGROUND

Upon the passing and burying of a loved one, there is a desire, indeed often a need, for family and friends to visit the cemetery and leave any of a variety of personal and sentimental items. However, often such items are not constructed to be resistant to the elements (e.g., rain, snow, sun). As such, if a personal item is left or displayed at a gravesite, and is of sentimental value, it would be most desirable to be able to, at minimum shield the item from the weather and elements.

In addition, when considering items such as greeting and holiday cards, photos, etc, there is a tendency for such items to be blown and dislodged from a selected location by the wind. Accordingly, it would be most helpful to have a display device that could be used to enable paper and light weight items such as photos and cards to be safely displayed such that they are not subjected to wind, rain, UV radiation, and other elements.

Therefore, it would be most desirable to have a weatherproof gravesite memorial display that would be available for use at a gravesite to hold any of a variety of personal, memorial, and or sentimental items, possibly made of paper or other light weight materials. Additionally, most preferable embodiments of the gravesite display device of the invention would provide a weathertight interior for housing such items. A number of other characteristics, advantages, and or associated novel features of the present invention, will become clear from the description and figures provided herein. Attention is called to the fact, however, that the drawings are illustrative only. In particular, the embodiments included and described, have been chosen in order to best explain the principles, features, and characteristics of the invention, and its practical application, to thereby enable skilled persons to best utilize the invention and a wide variety of embodiments providable that are based on these principles, features, and characteristics. Accordingly, all equivalent variations possible are contemplated as being part of the invention, limited only by the scope of the appended claims.

SUMMARY OF PREFERRED EMBODIMENTS

In accordance with the present invention, a weatherproof gravesite memorial display includes a shell structured to enclose an interior. The shell or shell portion is constructed of at least one fixed portion and at least one movable portion. The movable portion is suitably coupled to the fixed portion, and therewith substantially encloses and establishes the interior. In addition, the movable portion is preferably hinged to the fixed portion such that the movable portion is movable between a closed position, wherein the interior is sealed (weatherproof), and an open position, providing access to the interior. When in the open position, an individual may place items for display purposes within the interior and or remove items from the interior.

Preferable embodiments of the invention may be structured with a shell composed of flattened portions, that may result in substantially planar front surface and a substantially planar back surface. Importantly, a transparent portion is fixed to, and provides at least a portion of, at least one of the movable portion of the shell and the fixed portion of the shell. The transparent portion is included for enabling nearby individuals to see items contained, for display purposes, within the interior of the memorial display. As such, a most preferable embodiment may provide a front facing surface that is substantially provided by the transparent portion. It may be assumed that the phrase "is substantially provided by the transparent portion" indicates that the transparent portion may provide 50% to 95% of the front facing surfaces of the shell of preferred embodiments. This configuration is therefore structured to seal internally thereto at least one item, which may be viewed through the transparent portion by nearby individuals visiting the gravesite and positioned in front of the gravesite memorial display (and a headstone when the gravesite memorial display is properly positioned).

Also included with the present invention is a latching means that provides for the secure and sure holding (coupling) of the movable portion of the shell in a closed position, when access to the interior is not needed. As such, the latching means, which may be provided by skilled persons in a number of suitable arrangements, ensures that a weathertight sealing of the interior is established when the movable portion is in the closed position and tightly fixed or coupled to the fixed portion and the transparent portion. It may also be noted that the term 'edge portions' will be used to describe the actual locations where the movable, fixed, and or transparent portions are fixed and or coupled (e.g., via the latching means, etc.) to form the weathertight interior.

To further ensure that a weathertight sealing of the movable portion is effected (when in the closed position), most preferred embodiments will include a seal, such as a rubber gasket. The seal or gasket would preferably be fixed to at least one of the fixed portion or the movable portion proximate to edge locations. Accordingly, an included seal is structured for forming the weathertight seal where edge portions contact edge portions, as will be discussed in greater detail hereinafter.

It may be noted that a most preferred weatherproof gravesite memorial display in accordance with the invention may be configured with at least one flower holder, providable so that one or more flowers may be held and presented thereby. It is contemplated that a plurality of flower holders may be included with each flower holder being one of:

removably fixable to the shell such that each flower holder may be removed when not being utilized for holding flowers;

fixed to the shell and always available for holding flowers; and or fixed to the shell such that each flower holder may be rotated out of sight, as viewed from a frontward direction, when not needed for holding flowers.

When considering the placement of the gravesite memorial display at the gravesite, it would be most helpful to have a means that can be employed maintain the display at a selected location and in a selected orientation. For example, preferred embodiments may include at least one downwardly extending stake. Each stake may be removably fixable to the shell of the memorial display and configured to be driven into a ground surface. Each included stake would be fixable to the shell such that an orienting of the gravesite memorial display in either one of a landscape orientation or a portrait orientation would be possible. In addition, or alternately, the present invention may be embodied with a base arranged for being placed upon a supporting ground surface, proximate to a gravesite marker, as well as possibly upon a top surface of the gravesite marker itself. The base may be structured with a slot into which a lower portion of the memorial display may be placed in order to maintain the display in a selected and upright position. It may be noted that the base may be used during periods when the ground surface is, for example, frozen. At such times, it may be extremely difficult, to drive the hereinabove discussed stakes into the ground surface.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

PARTIAL LIST OF REFERENCE NUMERALS

10—(gravesite) memorial display
12—shell
16—fixed portion (of shell)
20—interior (of shell)
24—transparent portion (of shell)
26—movable portion (of shell)
30—latching mechanism
32—seal or sealing means
32*a*—channel or groove
34—hinge means or hinge
38—flower holder
38*a*—upper opening of 38
38*b*—keyed mounting plug
40—keyed mounting port
44—stake
44*a*—second or pointed end of 44
46—stake holder or support
48—shelf
50—clip
54—handle
70—message placards
72—message scroll
76—support base or base
76*b*—upper opening or slot in 76
78—locking mechanism
80—ground surface

DETAILED DESCRIPTION OF EMBODIMENTS OF THE INVENTION

It is important to establish the definition of a number of descriptive terms and expressions that will be used throughout this disclosure. The term 'shell' will be used to describe an outer enclosure, which will include several portions that collectively enclose an interior. When the shell is sealed, the interior will be substantially shielded from the elements and may be termed 'weatherproof'. However, it should be understood that it may be desirable to include one or more small openings, for example, in a lower or downward facing portion of the shell. Such openings may be included to enable the interior to breathe, thereby reducing or eliminating the formation of condensation within the interior of the shell. Alternately, a weatherproof shell may be fully and completely sealed establishing an interior that is truly waterproof. Terms indicating a direction or position, as employed in this disclosure, may be assumed to have their normal meaning, when these terms are applied to the views of the invention provided in the accompanying figures. For example, the terms 'lower' and 'upper' may be assumed to be applied to the invention and descriptions thereof, with the invention and elements thereof in the orientations depicted in each figure. Further the terms 'back' or 'rear' are employed for viewing or referencing surfaces best viewed from behind the gravesite memorial display of the invention (when placed at the gravesite location). Similarly, the terms 'front' and 'frontward' are employed for viewing or referencing surfaces best viewed from in front of embodiments of the invention (when placed at the gravesite). Other important terms and definitions will be provided, as they are needed, to properly define the present invention and its associated novel characteristics and features.

Figure 1:
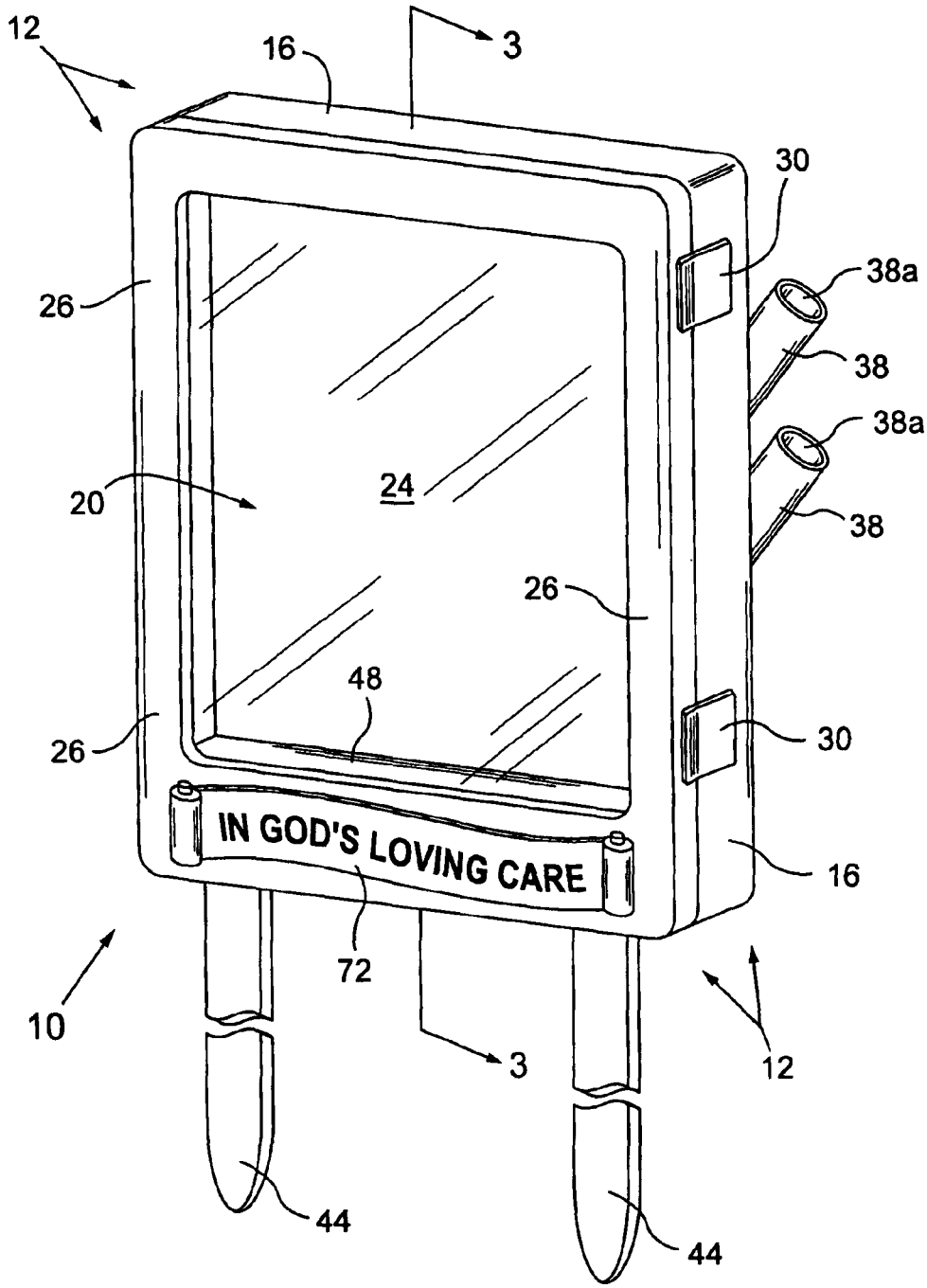
FIG. 1 is an elevated front perspective view of a first embodiment of a gravesite memorial display in accordance with the invention, and depicted in a closed position, or a closed (sealed) state.
Figure 2:
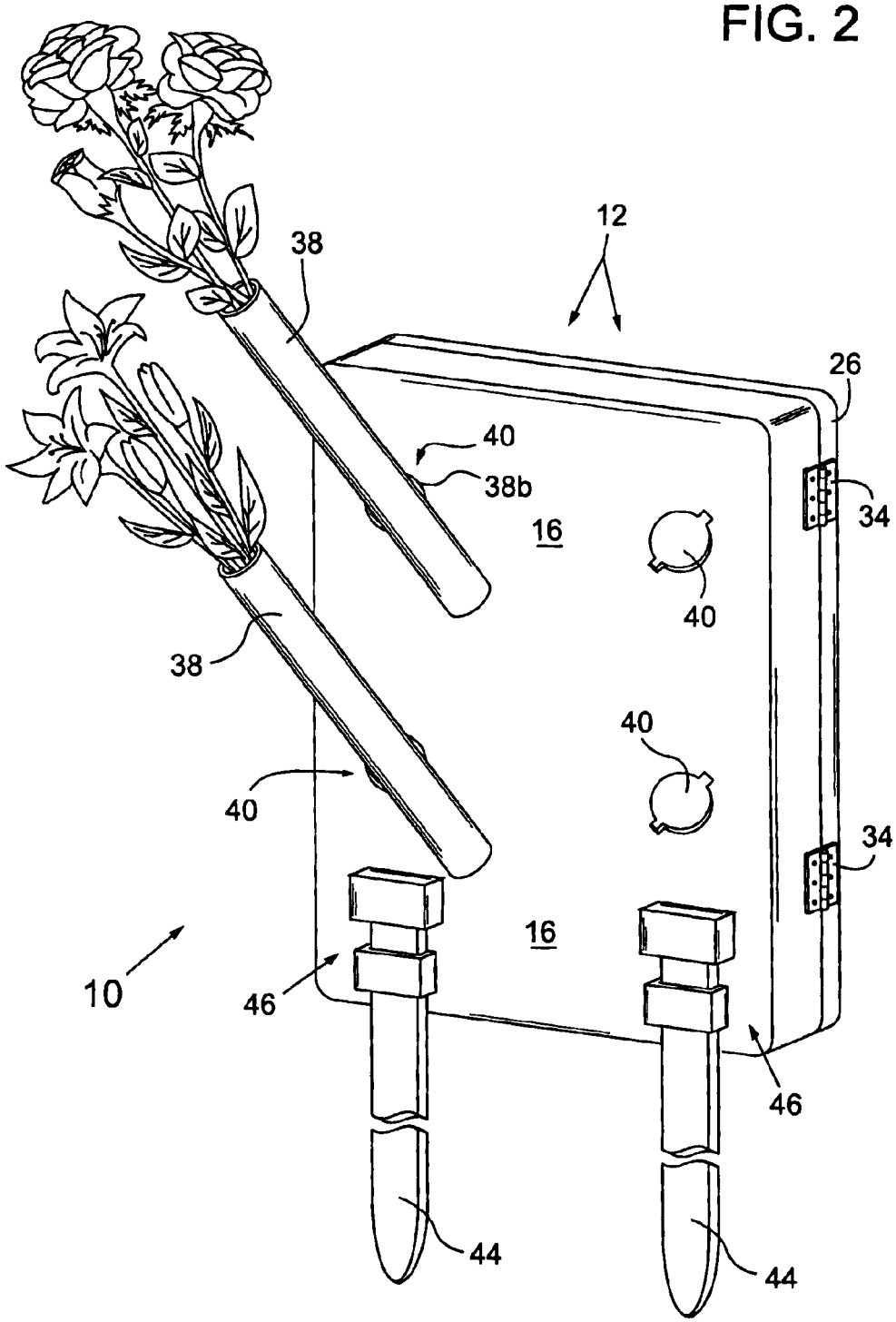
FIG. 2 provides a rear perspective view consistent with the embodiment depicted in FIG. 1, again shown in a closed position.
Figure 3:
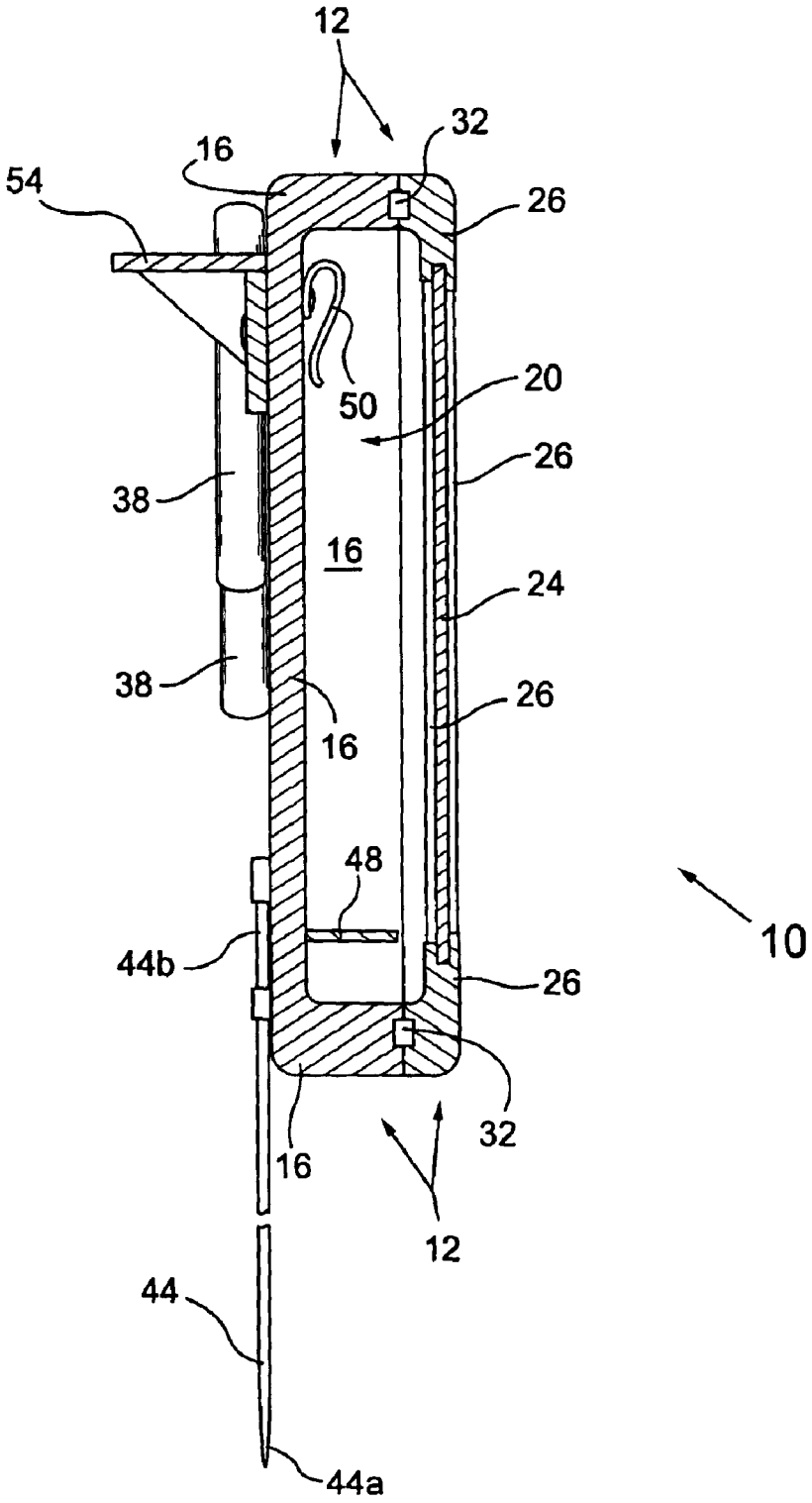
FIG. 3 is a cross sectional side view of the embodiment taken along the line 3—3 of FIG. 1.
Figure 4:
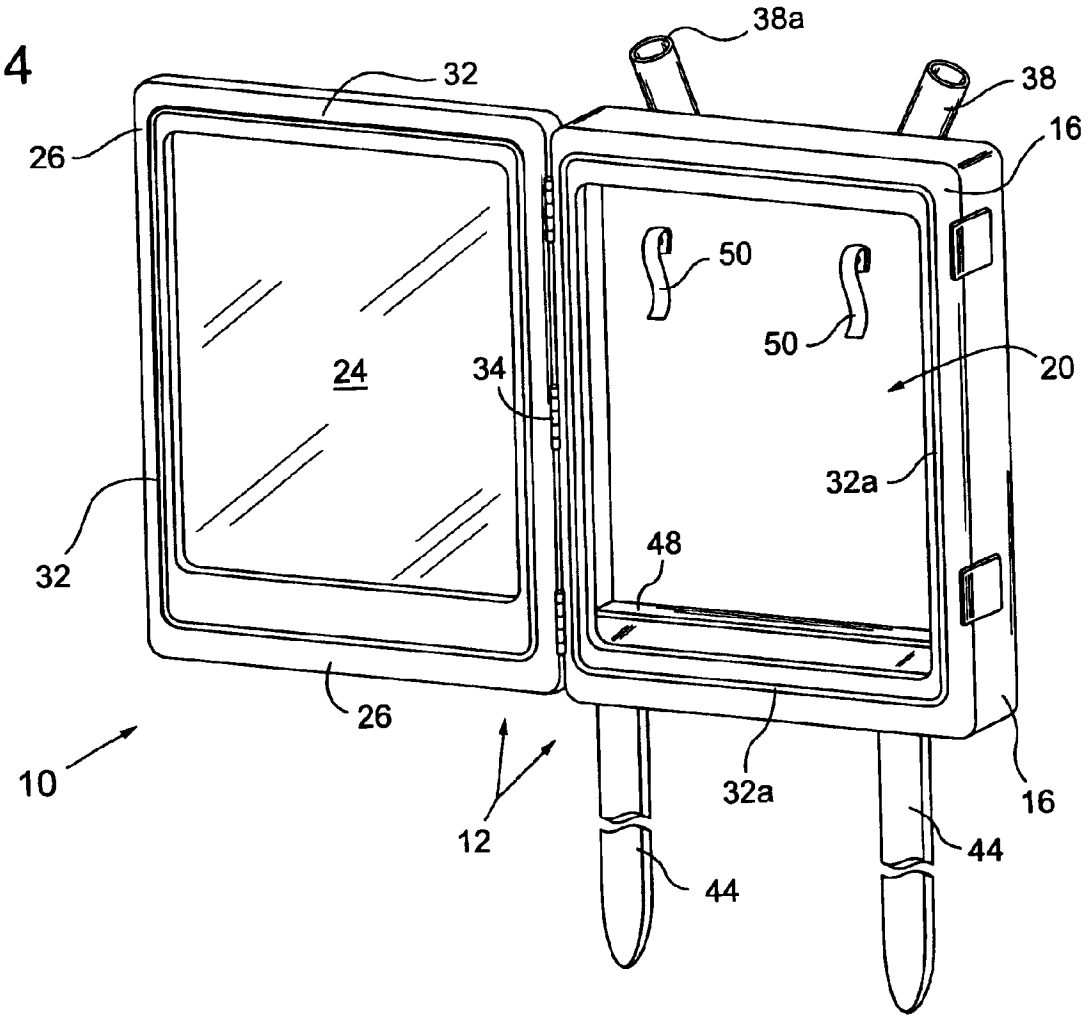
FIG. 4 illustrates an embodiment of the gravesite memorial display in an open position or open state, wherein one or more items may be loaded into the interior of the shell of the memorial display for subsequent viewing by nearby persons.

Referring now to the drawings, FIG. 1 provides an elevated front perspective view of a first embodiment of a gravesite memorial display 10 in accordance with the invention. The gravesite memorial display 10, which may be equivalently referred to as the memorial display or simply the display, includes a shell 12. The shell 12 is structured to enclose an interior 20, which is best seen in FIGS. 3 and 4. As clearly indicated in FIG. 1, the shell 12 preferably includes at least one fixed portion 16 and one movable portion 26. The movable portion 26 is coupled to the fixed portion 16 so as to be movable between a closed position (as shown in FIGS. 1–3) and an open position (as depicted in FIG. 4). When in the closed position the interior 20 is sealed and may be termed 'weathertight' or 'weatherproof'. When the movable portion 26 is in the open position, an individual is provided access to the interior 20, enabling one or more items to be placed, for display purposes within the interior 20, or removed from the interior after being previously displayed.

The shell 12 further includes at least one transparent portion 24. The transparent portion 24 is preferably fixed to at least one of the movable portion 26 or the fixed portion 16. It should be noted that most preferred embodiments may be provided wherein the transparent portion 24 provides most, if not all, of the front surface or front facing structure of the movable portion 26. It is certainly intended that the present claims read on such embodiments.

Figure 5:
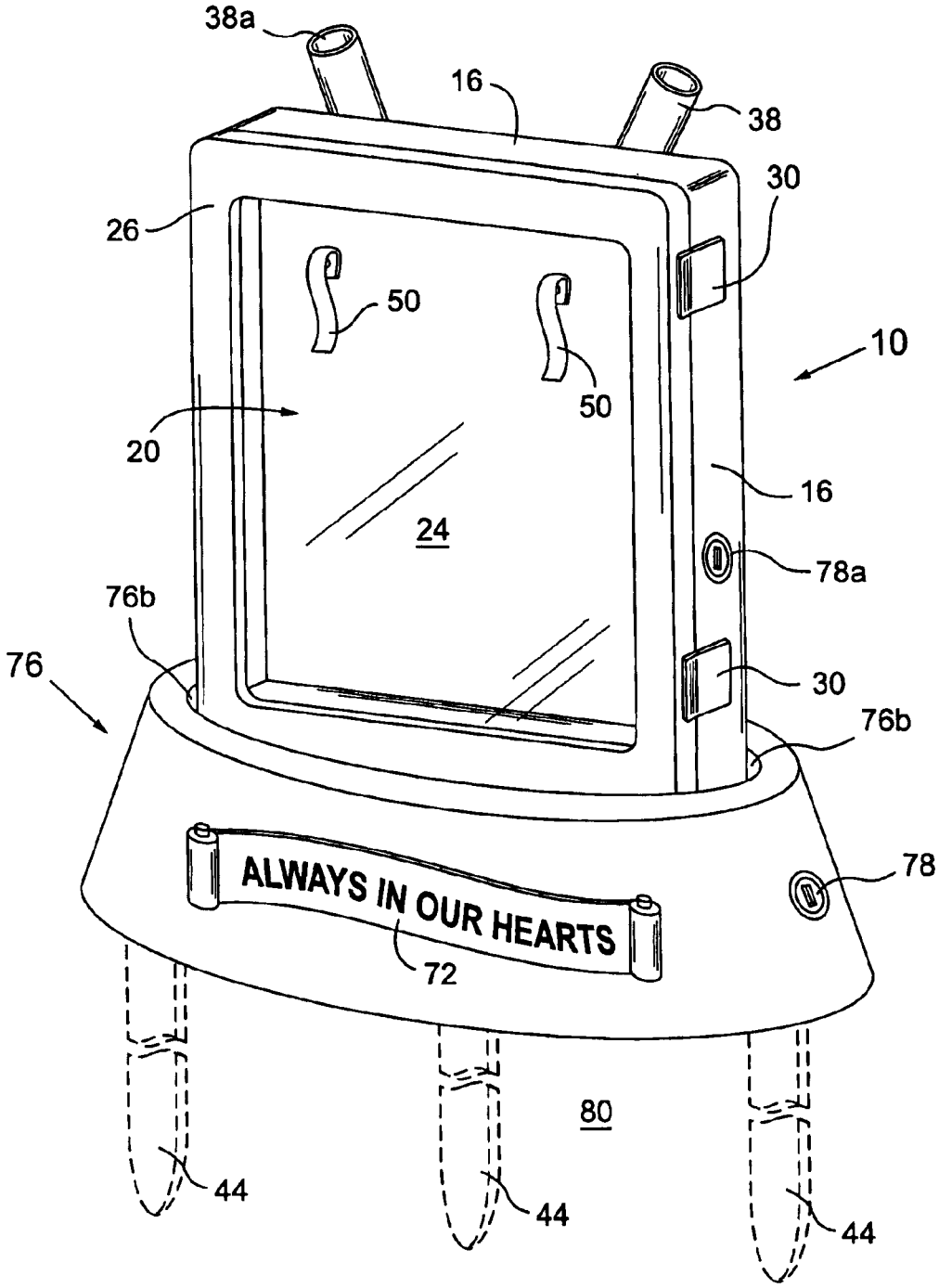
FIG. 5 is an elevated perspective view of another embodiment of the invention depicted set into a slot of an included base portion.

In order to securely hold (maintain) the movable portion 26 in the closed position, and thereby providing for the weathertight sealing of the interior 20, a latching means is preferably included. As understood by skilled persons, latching means may be provided in a wide variety of embodiments. For example, a latching means of the present invention may include a hinge means 34, as best seen in FIG. 2, and a clasping or latching mechanism 30, as best seen in FIGS. 1 and 5. Alternately, sliding arrangements may be provided wherein the movable portion may be placed within spaced linear channels provided in the fixed portion and slid into a closed position (sealing the interior). As such, the term latching means is to be broadly defined.

Another important aspect of the present invention calls for the inclusion of flower holders 38. As shown in FIG. 1, and possibly best seen in FIG. 2, each flower holder 38 may hold a small plurality of flowers. As depicted, preferably structured flower holders 38 may be elongated and possibly cylindrically shaped with an upper opening 38*a* provided at an upper or first end, while a second or lower end is sealed. Accordingly, each flower holder 38 may also hold a volume of water to aid in sustaining the flowers inserted into a respective flower holder 38.

A most preferred embodiment of the gravesite memorial display 10 will include one or more flower holders 38 that may be arranged to be coupled/fixed to the shell 12, or alternately formed as a portion of the shell (not illustrated). For example, as illustrated in FIGS. 1 and 2, embodiments of the gravesite memorial display 10 may provide flower holders 38 that are removably fixable to the shell 12. As such, one or more flower holders 38 may be structured (along with the shell) for supporting such a removable coupling such that one or more respective flower holders 38 may be removed from the shell 12 when not being utilized for holding flowers. As illustrated in FIG. 2, the flower holders 38 may include a keyed mounting plug 38*b*, which as fully understood by skilled individuals, mates to a receptacle such as the keyed mounting port 40. Clearly many arrangements and structures may be provided for removably fixing flower holders 38 in accordance with the present gravesite memorial display invention. Another, low cost arrangement may provide that the flower holders are simply inserted into openings or loops formed in the shell 12 (not illustrated). Yet other embodiments of the invention may be arranged with flower holders 38 that are rotatably fixed to the shell 12. As an example, if the flower holders 38 of FIGS. 4 and 5, are not needed for holding flowers, each flower holder 38 may be rotated, possibly in opposite rotational directions, out of sight behind a rear surface or rear panel causing a downward orienting of the open end 38*a*. Such a rotating and downward orienting of a respective flower holder 38 would not only enable the unused flower holders 38 to be moved out of sight, but would further prevent water from collecting in the flower holders 38 when not being used.

When removable flower holders 38 are required, embodiments of gravesite memorial display 10 may simply be structured with one or more flower holders 38 that are fixed (e.g., glued or fastened) to the shell 12, or alternately formed within portions of the shell 12, and are therefore always ready and available for holding flowers therein.

Turning now to FIG. 3, a preferred embodiment of the invention is illustrated in a cross sectional side view, taken along the line 3—3 of FIG. 1. As illustrated, the shell 12 may be formed of a first concaved portion, say provided by fixed portion 16, which is opposingly coupleable to a second concaved portion, say provided by movable portion 26. As depicted in FIG. 3, when the first concaved portion and the second concaved portion are opposingly coupled, each may be held (coupled) together with edge portions in direct contact (as illustrated). The direct contacting of edge portions of the first and second concaved portions may be maintained by any of a variety of structures know to skilled persons. For example, a latching means such as latching mechanism 30 and a hinge 34 (as discussed hereinabove) may cause a sealing of the interior 20, providing the weathertight interior 20 in accordance with the invention. It may be noted that a possibly most preferred shell 12 may be structured to be substantially flattened, as illustrated, providing a somewhat thin and flattened memorial display.

Figure 6:
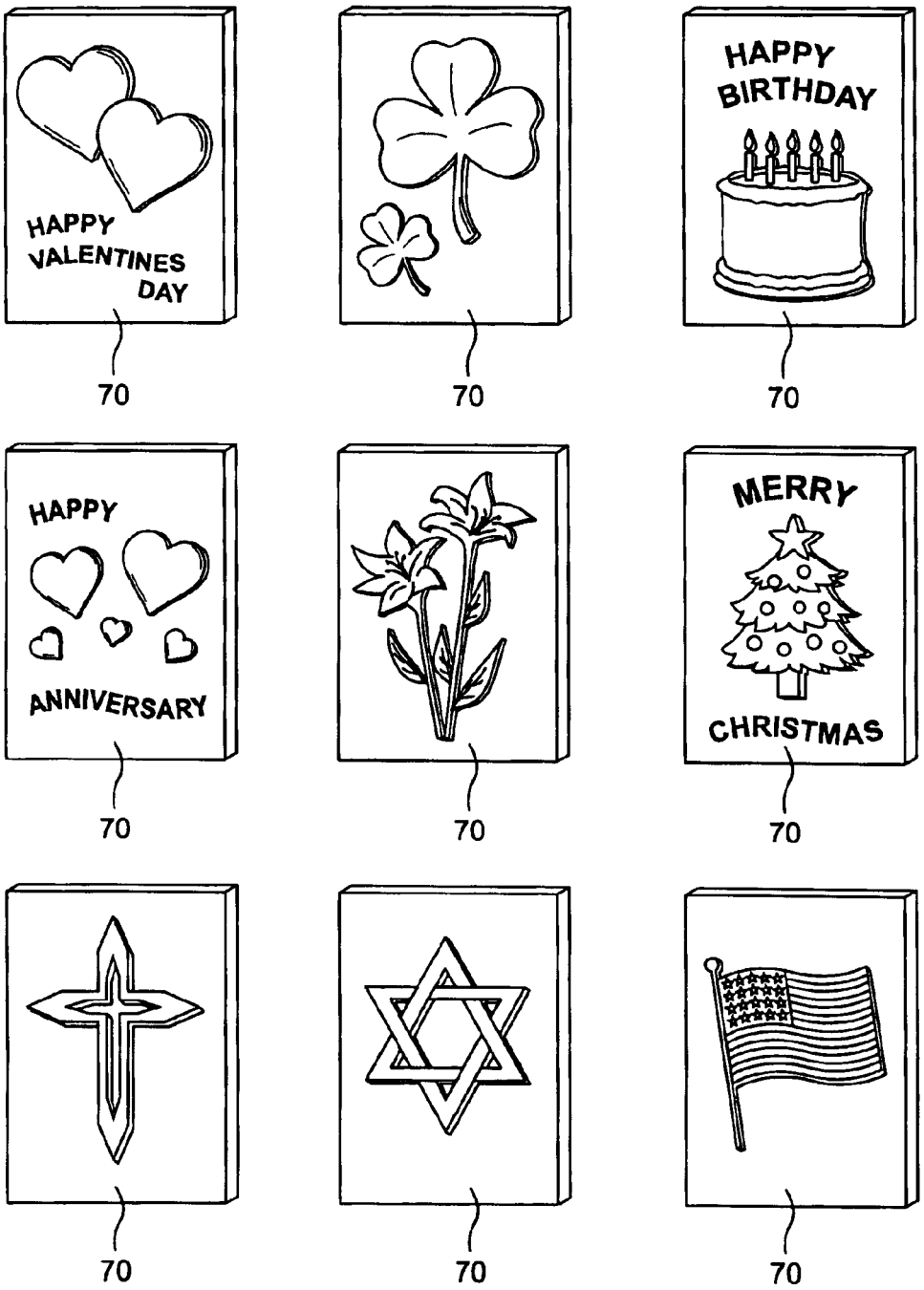
FIG. 6 provides a plurality of pre-defined message placards that may be employed with the invention to salute a variety of different occasions and or holidays.

FIG. 3 also illustrates several other elements that may be included with the present invention. These include a handle 54, depicted as a flattened portion that extends substantially orthogonally from a rear surface (opposite the transparent portion 24 in the embodiment depicted). The handle 54 may be included to aid an individual in placing the gravesite memorial display 10 of the invention at a selected position and in a selected orientation, at a gravesite. It may be noted that the handle 54 may be fixed to the rear surface (as shown in FIG. 3), or alternately formed as a portion of the fixed portion 16 of the shell 12 (not illustrated). In addition to a handle like structure, one or more clips 50 may be provided within the interior 20 of the shell 12, to aid in supporting and or displaying items placed within the interior 20 for display purposes. For example, if a photograph, greeting card, or a message placard 70 (of FIG. 6) is to be displayed for viewing through the transparent portion 24, such items may be clipped under one or more clips 50. It should be noted that the clips 50 may be structured to hold a displayed items (e.g., a greeting or holiday card), against a back wall of the shell (as illustrated), or alternately, directly against an inner surface of transparent portion 24. In this latter case, the clips 50 may be provided fixed directly to the transparent portion 24, or an inner surface of an upper/top wall structure of the shell 12.

Yet another structure that may be included is a shelf 48, providable as illustrated in FIG. 3 as a thin, elongated member, which may be fixed to extend from an inside surface of the fixed portion 16. The shelf 48 may be included for supporting a bottom edge or lower portion of an item being displayed in the gravesite memorial display 10.

Referring again to FIGS. 3 and 4, there is illustrated therein an exemplary sealing means. As shown a sealing means, such as seal 32 may be included and possibly structured to mate with one or more grooves 32*a* (or channels), which are compressingly filled by the seal 32, whenever the movable portion 26 is placed and secured in the closed position. As appreciated by those skilled in the art, such an arrangement of the seal 32 and at least one channel or groove 32*a*, provided at or proximate to 'edge portions' of the fixed portion 16 and or the movable portion 26, may certainly be structured to provide a weathertight sealing of the interior 20 when the movable portion 26 is secured in the closed position.

Another aspect of the present invention provides for embodiments of the invention that include one or more means to maintain the gravesite memorial display 10 at a selected location at the gravesite, and in a selected orientation. A first embodiment may include one or more stakes 44, that are fixed or fixable to the shell 12, as for example depicted in FIG. 2. As shown, stakes 44 are most preferably elongated, and provided with a second pointed end 44*a*. It should be understood that the present invention may include removably fixable stakes 44. Turning again to FIG. 2, the stakes 44 are shown fixed to the shell 12 via a plurality of stake holders 46 formed in, or fixed to, the fixed portion 16.

Importantly, other arrangements may certainly be provided by skilled persons for enabling a removable fixing of an upper or first end of each stake to the shell of the gravesite memorial display. Additionally, when considering applicable embodiments, it should be understood that the stake holders 46, and equivalents thereto, may be provided to support and maintain the gravesite memorial display 10 in either a portrait orientation (as illustrated) or a landscape orientation.

Referring again to FIG. 5, yet another means is illustrated that may be employed to support gravesite memorial display 10 at a selected location at the gravesite. A support base, such as base 76, may be included for use where hard or frozen ground surfaces are encountered. The base 76 would preferably be structured with a heavy mass, which would make it difficult to move or tip over, and structured with an upper opening, such as slot 76*b*, into which a lower portion of the gravesite memorial display 10 may be placed (inserted). A most preferred mass for the base 76 may be determined by considering factors including the size and mass of the respective gravesite memorial display 10 being utilized, and may most typically be substantially in the range of 15 to 50 pounds, or more. In addition, the base 76 may be arranged to be filled with sand or water to provide additional mass, if needed.

Turning again to FIG. 5, and as indicated using dashed lines, embodiments of the base 76 may be further structured to accept one or more stakes 44. In such cases, the stakes 44 would be fixable to the base 76 so as to extend downwardly therefrom. When stakes 44 are employed, and fixed to a base 76, the base may be secured at a ground location by driving the stakes 44 into the ground surface, making it difficult for the base 76 to be moved, removed or stolen.

Further, if locking means are included, individuals may be deterred from stealing a gravesite memorial display 10, left at a gravesite, as well as items placed and displayed therein. As shown in FIG. 5, one contemplated locking means may involve a configuration wherein a mechanical or electronic key is used to selectively place a locking mechanism 78 or 78*a* in a locked state or an unlocked state. For example, consider locking mechanism 78. When in an unlocked state a gravesite memorial display 10 may be inserted into the slot 76*b* (or removed therefrom). Once inserted, an individual may lock the locking mechanism 78, securing the gravesite memorial display 10 in the base 76 until the locking mechanism 78 is again placed in the unlocked state. Similarly, a locking mechanism 78*a* may be included for preventing easy and unauthorized access to the interior 20 of the shell 12.

Additional locking means may be placed within, or formed within the shell 12 of the display 10, such that once items have been placed within the interior 20 for display purposes, a second locking mechanism 78 may be locked, preventing the interior 20 of the memorial display from being accessed until the second locking mechanism is unlocked.

Returning again to FIGS. 1 and 5, clearly depicted are several embodiments of message scrolls 72. Each message scroll may hold a saying or short message. In addition, embodiments of the invention may include a variety of message scrolls that may be arranged to be removably fixed to the display 10 and or base 76 by any suitable and known means. For example, hook and eye tape, magnets, pins/receptacles, etc., may be employed.

While there have been described herein a plurality of the currently preferred embodiments of the present invention, along with contemplated methods of operation and use, those skilled in the art will recognize that other and further modifications may be made without departing from the invention. As such, the foregoing descriptions of the specific embodiments of the present invention have been presented for the purposes of illustration, description, and enablement. They are not intended to be exhaustive or to limit the invention to the specific forms disclosed and or illustrated. Obviously numerous modifications and alterations are possible in light of the above teachings, and it is fully intended to claim all modifications and variations that fall within the scope of the appended claims provided hereinafter.

What is claimed is:

1. A gravesite memorial display, comprising:

a) a shell structured to enclose a weathertight interior, the shell including:

i) at least one fixed portion;

ii) at least one movable portion, which is coupled to the fixed portion and substantially forms the interior, the movable portion movable between a closed position, wherein the interior is sealed, and an open position, providing access to the interior enabling an individual to place items for display purposes within the interior or remove items from the interior;

iii) a transparent portion fixed to at least one of the movable portion of the shell and the fixed portion of the shell;

b) latching means for securely holding the movable portion of the shell in a closed position, when access to the interior is not needed, and when a weathertight sealing of the interior is to be established;

c) a seal structured for forming the weathertight seal where edge portions of the movable portion contact edge portions of the fixed portion;

d) wherein the seal is provided by a rubber gasket fixed to at least one of the fixed and the movable portions of the shell by being partially embedded within an included groove; and e) means to maintain the gravesite memorial display at the gravesite at a selected location and orientation;

f) the gravesite memorial display therefore structured to seal in a weathertight manner, and internally thereto for display purposes at the gravesite, at least one item that may be viewed by nearby individuals including friends, family, or other visitors.

2. The gravesite memorial display as recited in claim 1, wherein at least one flower holder is further included so that one or more flowers may be held thereby proximate to the shell of the memorial display for aesthetic purposes.

3. The gravesite memorial display as recited in claim 2, wherein a plurality of flower holders are included and each is one of:

a) removably fixable to the shell such that each flower holder may be removed when not being utilized for holding flowers;

b) fixed to the shell and always available for holding flowers; and c) fixed to the shell such that each flower holder may be rotated out of sight, as viewed from a frontward direction, when not needed for holding flowers.

4. The gravesite memorial display as recited in claim 1, wherein the shell is flattened having a flattened front surface and a flattened back surface, with the transparent portion being substantially planar, and fixed to the movable portion of the shell portions for providing a substantial portion of the front surface.

5. The gravesite memorial display as recited in claim 1, wherein the means to maintain the gravesite memorial display at the selected location and in a selected orientation, at the gravesite, includes at least one of:

a) at least one downwardly extending stake that is fixable to the shell of the memorial display for orienting the display in either one of a landscape orientation and a portrait orientation, when each included stake is driven into a ground surface; and b) a base arranged for being placed upon a supporting surface and structured with a slot into which a lower portion of the gravesite memorial display may be placed.

6. The gravesite memorial display as recited in claim 5, when configured with the base, further including a plurality of downwardly extending stakes that are fixable to the base.

7. The gravesite memorial display as recited in claim 5, further including a handle that is fixed to the back surface of the shell of the memorial display, and arranged to aid an individual when driving at least one stake, fixed to the memorial display, into the ground surface proximate to the gravesite.

8. A gravesite memorial display for holding and displaying items, at a gravesite location, within a weathertight interior, the memorial display comprising:

a) a shell formed of a first concaved portion opposingly coupleable to a second concaved portion for substantially forming a weathertight interior when coupled together, with the interior accessible for enabling items to be placed within the interior or removed from the interior, as required;

b) at least one transparent portion provided as at least a portion of one of the first concaved portion and the second concaved portion;

c) a seal located between edge portions of the first concaved portion of the shell and the second concaved portion of the shell for sealing the edge portions so that when the first and second concaved portions are coupled together, the interior is sealed in a weathertight manner;

d) means for securely coupling together the first concaved portion and the second concaved portion;

e) means to establish and maintain the gravesite memorial display at the gravesite at a selected location and orientation so that one or more items placed within the interior may be displayed at the gravesite; and f) a plurality of flower holders structured for holding, sustaining, and displaying a plurality of flowers, wherein the plurality of flower holders are removably fixable to the shell, for use when needed for holding flowers.

9. The gravesite memorial display as recited in claim 8 wherein each of the first concaved portion and the second concaved portion of the shell are substantially flattened structures forming a flattened memorial display.

10. The gravesite memorial display as recited in claim 8, wherein the seal is provided by a rubber gasket fixed to at least one of edge portions of the first concaved portion and edge portions of the second concaved portion.

11. The gravesite memorial display as recited in claim 8, wherein the shell portions, including the first concaved portion, the second concaved portion, and the transparent portion, are constructed of at least one of:

a) opaque plastic;

b) transparent plastic;

c) glass;

d) stained glass; and e) stainless steel.

12. The gravesite memorial display as recited in claim 8, wherein the coupling of the first concaved portion to the second concaved portion includes the use of at least one hinge means and at least one latching means, each of which is fixed to at least one of the first concaved portion, the second concaved portion, and the transparent portion.

* * * * *